US005757131A

United States Patent [19]

Tsuchiya

[11] Patent Number: 5,757,131

[45] Date of Patent: May 26, 1998

[54] COLOR PLASMA DISPLAY PANEL AND FABRICATING METHOD

[75] Inventor: Hideki Tsuchiya, Tokyo, Japan

[73] Assignee: NEC Corporation, Tokyo, Japan

[21] Appl. No.: 689,245

[22] Filed: Aug. 7, 1996

[30] Foreign Application Priority Data

Aug. 11, 1995 [JP] Japan ..... 7-205459

[51] Int. Cl.[6] ..... H01J 17/49

[52] U.S. Cl. ..... 375/582; 313/584; 313/585; 313/586; 313/587; 445/22; 445/23; 445/24

[58] Field of Search ..... 313/582, 584, 313/585, 586, 587; 445/22, 23, 24

[56] References Cited

U.S. PATENT DOCUMENTS 5,144,200 9/1992 Kim ..... 313/584

5,164,633 11/1992 Kim et al. ..... 313/586

5,182,489 1/1993 Sano ..... 313/586

5,440,241 8/1995 Martin et al. ..... 313/582

5,541,479 7/1996 Nagakubo ..... 313/587

*Primary Examiner*—Nimeshkumar Patel

*Attorney, Agent, or Firm*—Young & Thompson

[57] ABSTRACT

In each of discharge cells of a color plasma display panel, a data electrode is formed so as to cover entire side walls and bottom of the cell. A fluorescent layer is also formed on an entire surface of the data electrode to improve brightness. The barriers are provided by forming a plurality of grooves a glass substrate to reduce flicker of a screen. The surface of the substrate is made black to improve a display contrast.

11 Claims, 2 Drawing Sheets

COLOR PLASMA DISPLAY PANEL AND FABRICATING METHOD

BACKGROUND OF THE INVENTION

1. Field of the Invention

The present invention relates to a color plasma display panel and fabricating method thereof, and more particularly, to the structure of a data electrode that improves a display quality.

2. Description of Related Art

An AC type plasma display panel is advantageous in intensity, lights emitting efficiency and life among these displays.

FIG. 1 shows a discharge cell structure of a conventional reflection type AC plane discharge plasma display panel. The transparent electrode 2 and the bath electrode 9 formed on a cover plate 1 are covered with a transparent insulation layer 3. A protective layer 4 is formed in order to cover the transparent insulation layer 3. The protective layer 4 is made of, for example, a thin film of MgO.

On the other hand, a display data writing data electrode 15 is formed on a substrate 8. The data electrode 15 is covered with an insulation layer 12 made of glass with a low melting point. The data electrode 15 is perpendicular to a paper surface in FIG. 1, that is, it crosses at a right angle to the transparent electrode 2. Barriers 14 are formed thereon by normally carrying out a thick film printing technique. Further, a fluorescent material 13 is coated on a portion constituting each of the discharge cells. The insulation layer 12 has a role of a foundation for strongly securing the barriers 14.

The fluorescent layer 13 is also formed on side surfaces of the barriers 14 in order to increase a fluorescent coating area, that is, increase a light-emitting area. The discharge cells are filled with a discharge gas such as a mixed gas of He, Ne and Xe of approximately 500 Torr.

When an alternative voltage in a form of a pulse is applied between a pair of the transparent electrodes 2 adjacent to each other (in FIG. 1, the transparent electrodes are located parallel to the paper surface, and they are adjacent to each other in a direction perpendicular to the paper surface), gas discharge (plane discharge) is generated, and thereby the plasma is generated in a discharge gas space 10. The fluorescent material 13 is excited by the plasma and thus visible light is observed through the cover plate 1. The bath electrode 9 on the transparent electrodes 2 adjacent to each other for generating the plane discharge is composed of a scanning electrode. Actually, in a panel drive operation to display an image, discharge sustaining pulses are applied to the transparent electrodes that are the plane discharge electrodes. When the discharge is generated, a voltage is applied between the scanning electrodes and the data electrode 15, and thereby a counter discharge is generated. The counter discharge is kept between the plane discharge electrodes by the sustaining pulses. The image is prepared by carrying out the counter discharge by means of a desired cell in the screen. For this reason, this counter discharge is very important.

Three important parameters for generating this counter discharge are an interval between the scanning electrode and the data electrode 15, the voltage applied to this discharge gap and a pressure of the mixed gas inside the discharge gas space 10. The so-called Paschen's law is established between these three parameters, which states that the voltage applied to the gap to generate the discharge is determined by a product of the discharge gap, applied voltage and the mixed gas pressure.

Therefore, these three parameters must be constant in order to assure generation of the counter discharge for carrying out the display light-emission.

Although it is easy to maintain the values of the applied voltage and the gas pressure at constant, it is difficult to keep the discharge gap constant for all of the cells. The reason for is that since the barrier 14 for establishing the discharge gap is formed by using printing techniques, it is difficult to keep a height of the barrier 14 constant on an entire screen because of variation of the print technique. This is especially difficult in the wide screen since a print area is increased. For this reason, there is a problem that since the discharge is not smoothly carried out, the screen of the color plasma display panel flickers.

Furthermore, when the fluorescent layer 13 is formed on the side surfaces of the barriers 14 and the cell bottom portion, the fluorescent layer 13 is not sufficiently formed on the side surfaces of the barriers 14 and the cell bottom portion because of the variation of the print condition and the like, when using a conventional thick film printing technique.

Moreover, it is necessary to form the above-mentioned insulation layer 12 on the substrate 8. This brings about a problem that the color plasma display panel is complex in construction and fabrication.

Furthermore, each barrier 14 is transparent or semi-transparent of glass. Thus, since the reflection coefficient is high for extraneous light, this brings about a problem of reduction of the contrast of the screen.

SUMMARY OF THE INVENTION

It is therefore an object of the present invention to provide a color plasma display panel which features an improved data electrode structure by which an improved display quality can be attained.

According to the present invention, each data electrode is provided on the bottom and side surfaces of each discharge cell.

Furthermore, a fluorescent layer is formed on an entire surface of the data electrode. Each barrier is obtained by forming a groove in a glass board whose surface is made black. Each data electrode is formed to contact with the groove.

In the present invention, as mentioned above, the data electrode of the color plasma display panel is formed so as to cover the side portion of the barrier and the cell bottom portion. Thus, since the discharge gap is made constant it is possible to easily maintain the voltage set by Paschen's law. Therefore, it is possible to prevent an abnormal discharge due to the variation of the barrier height resulting from the variation of the printing condition at a time of forming the barriers. As a result, the flicker of the screen can be-suppressed.

Since the fluorescent layer is sufficiently formed on the side portion of the barriers and the cell bottom portion, the light-emitting area is increased and its brightness is thereby improved.

Moreover, in the barriers, each groove is defined in the glass board, and the data electrode is formed so as to be in direct contact with this groove and over it. Thus, the fluorescent layer is not in direct contact with the glass board.

Since the barrier is formed in the glass board, it is possible to omit the conventional insulation layer for providing the conventional barrier. As a result, construction and fabrication are simplified.

And, since the glass surface is made black, the reflection coefficient for the extraneous light is reduced, and its display contrast can be improved.

DETAILED DESCRIPTION OF THE PREFERRED EMBODIMENT

Figure 1:
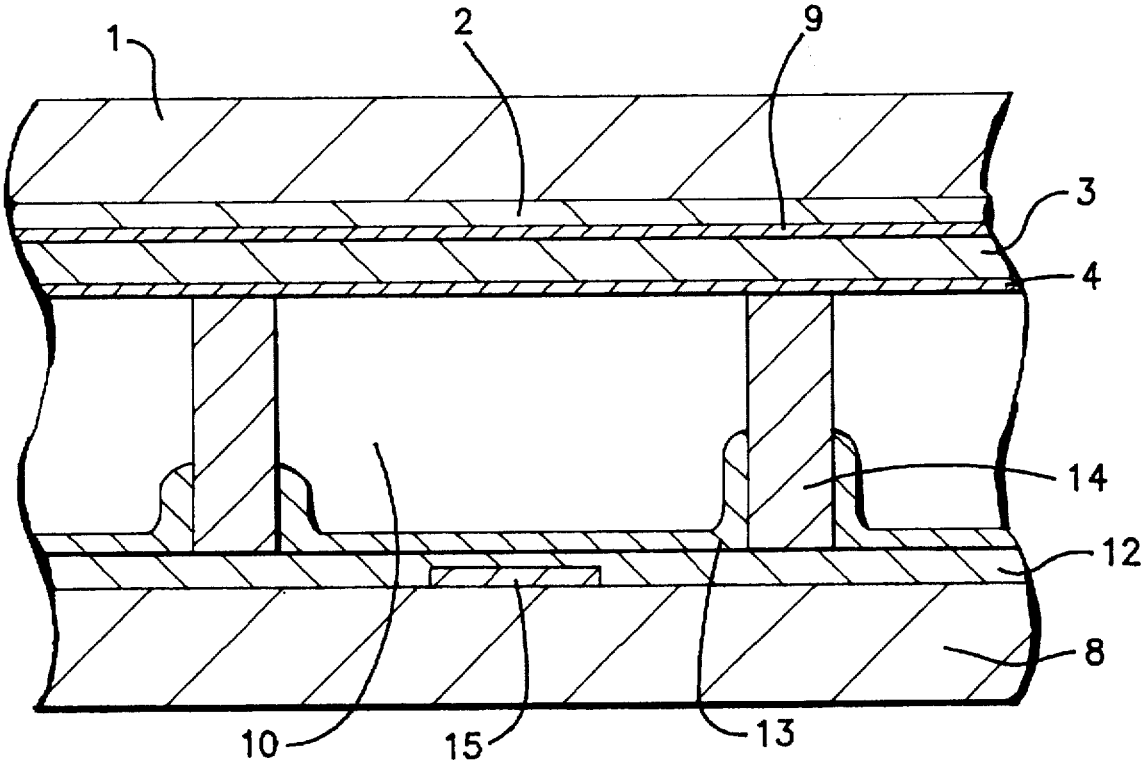
FIG. 1 PRIOR ART
FIG. 1 is a cross-sectional view of a conventional discharge cell of a prior art color plasma display panel.
Figure 2:
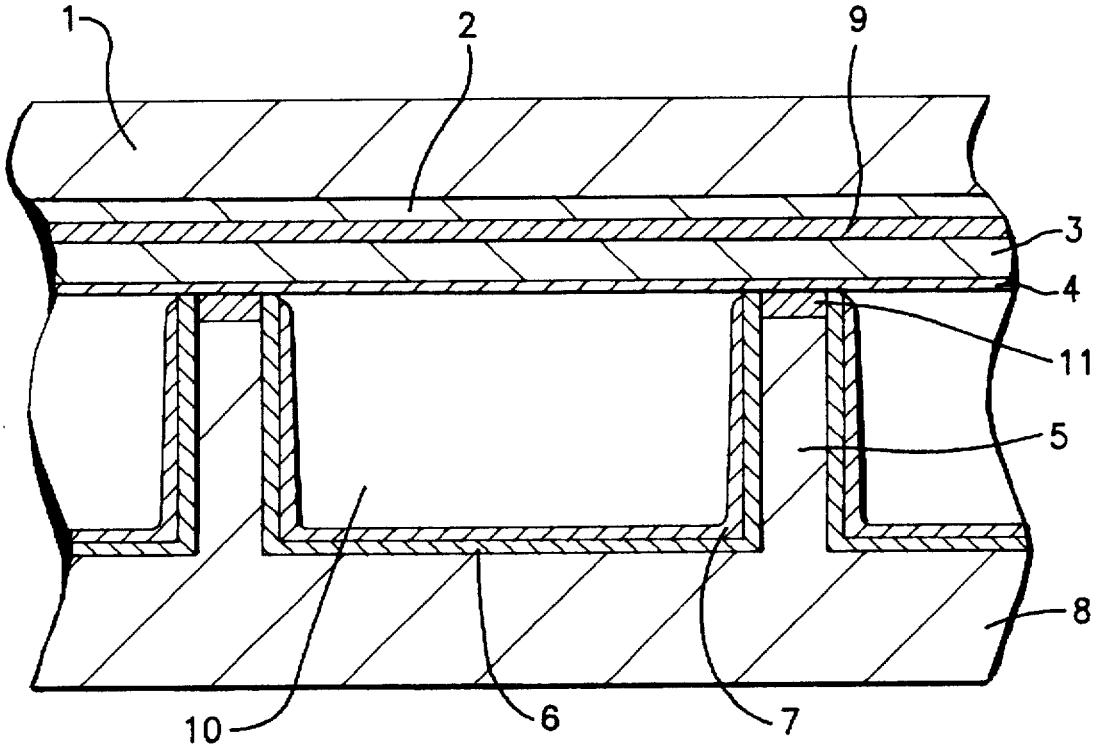
FIG. 2 is a cross-sectional view of a discharge cell of a color plasma display panel in accordance with the present invention.
Figure 3:
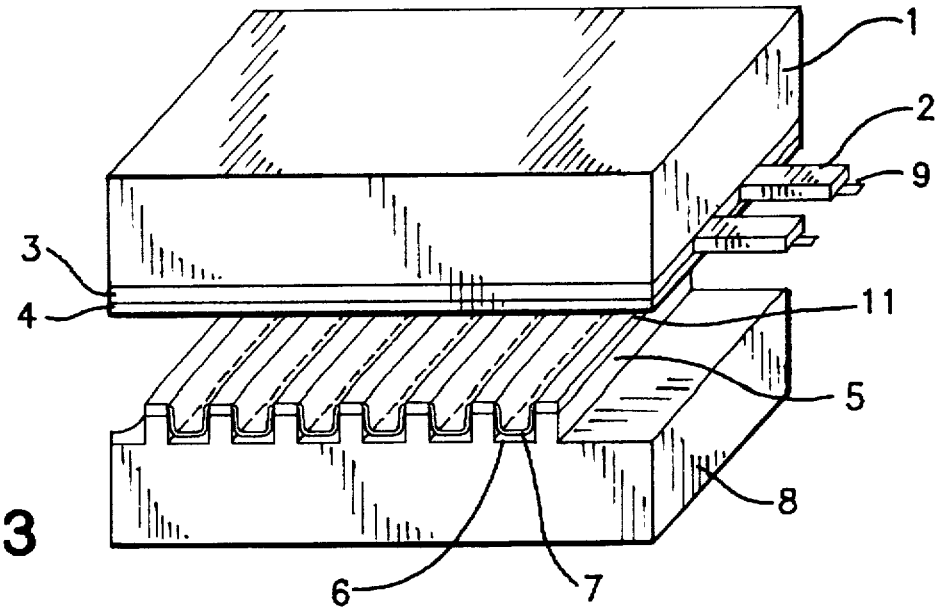
FIG. 3 is a perspective view showing one embodiment of the color plasma display panel in accordance with the present invention.

Referring to FIG. 2, a cover plate 1 has the same configuration of the conventional one shown in FIG. 1. Thus the explanation of it is omitted here. On the other hand, a substrate 8 has a different configuration.

A plurality of barriers 5 are provided by forming a plurality of grooves in a glass substrate 8. The grooves can be made by using a sand blast method. For example, negative resist having sand-blast-proof characteristic is coated on the glass substrate 8. Drying, exposing and developing processes are carried out. A resist pattern is formed on a portion defining the barriers. After that, abrasive material made of alumina powder is air-injected onto the substrate to selectively remove unnecessary portions. After that, by carrying out a baking process, it is possible to remove the resist layer, define the grooves in the glass substrate and form the barriers.

The sand blast method has advantages such that it is easy to adjust depth of the grooves with a fast etching speed.

Paste containing glass powder and black metal such as metallic oxide and the like is coated in advance on a surface of the glass substrate and is baked to thereby make the surface of the glass substrate black. The grooves are formed on this blacked glass substrate by using the above-mentioned sand blast method, and thereby a plurality of black areas 11 are formed on top portions of those the barriers 5. Because of blackend surfaces, extraneous light reflection coefficient is decreased and display contrast is improved.

A plurality of data electrodes 6 of the present invention are provided so as to cover side portions and bottom portions of the grooves defined in the glass substrate. Since the discharge gap is made constant, the Paschen's law voltage is easily maintained constant to avoid abnormal discharge. As for the forming process of the data electrodes 6, a so called additive method can be used which is popular in fabricating a printed circuit board. In this embodiment, an electroless silver plating is used for forming the data electrodes 6.

For example, the resist is printed on the black top portions 11 of the barriers 5 formed in the glass substrate 8, and the electroless silver plating is carried out successively. Since the resist is coated on the top portions of the barriers, the electroless silver plating is not coated thereon, and the silver plating is formed on the side portions of the barriers and the cell bottom portions. As a result, the data electrodes 6 can be formed so as to cover the side portions and the bottom portions of the grooves defined in the glass substrate 8. A plurality of fluorescent layers 7 of the present invention are formed on the data electrodes 6 by using an electric deposition method in which the above-mentioned data electrodes 6 are used as electric deposition electrodes. Accordingly, the entire surfaces of the data electrodes 6 are coated by the fluorescent layers 7. Thus, differently from the prior art, the fluorescent layer 7 is sufficiently formed on the side portions of the barriers 14. Further, the adhesive of the fluorescent layers 7 to the data electrodes 6 is extremely strong. As a result, it is possible to increase a surface area of each fluorescent layer, thereby increasing a light-emitting area to improve brightness. For example, fluorescent material is put into the mixing solution of magnesium nitrate, aluminum nitrate and ethanol, and then an electric deposition solution is prepared. Such fluorescent material can be negatively charged.

By dipping the glass substrate 8 into this electric deposition solution and applying a DC voltage thereto with the above-mentioned data electrode as an anode, the negatively charged fluorescent material can be deposited on the data electrodes 6 electrically.

In a case of a color plasma display panel, it is necessary to form a fluorescent layer having three colors of red, green and blue. For example, when forming the fluorescent layer with the green color as a first color, the electric deposition solution in which the fluorescent material with the green color is utilized and then a voltage is applied to only the data electrode located at the cell on which it is desired to form the fluorescent layer with the green color. For the other two colors, it is possible to sequentially carry out the operation similar to the case of forming the fluorescent layer with the green color to thereby form a desired fluorescent layer on a desired data electrode by using the electric deposition method..

When deposit the fluorescent material on each data electrode, since the data electrode is constituted so as to cover the side portions and the bottom portion of each groove defined in the glass substrate, the fluorescent layer can be formed on the entire plane of the data electrode. Thus, it is possible to increase the surface area of the fluorescent layer, that is, increase the light-emitting area to thereby improve the light intensity. And, as compared with the fluorescent layer made by means of the conventional printing manner, it is easier to obtain a uniform film of desired thickness by selecting a time the voltage is applied. Thus, it is possible to reduce the variation of a display brightness resulting from the variation of the film thickness. Further, the fluorescent material is not adhered on the top portion of each barrier. Thus, it is possible to prevent the generation of the so-called color mixture, in which a predetermined light-emitting color is mixed because of drop of the fluorescent material at the top portion of the barrier brought about at a time of sealing the substrate and the cover plate. Therefore, it is also possible to keep the purity of the color.

As mentioned above, the embodiment of the present invention has been described. However, in the present invention, since each of the fluorescent layers 7 is respectively formed only on each of the data electrodes 6, each of the fluorescent layers 7 is never in direct contact with the glass substrate.

Since the insulation layer 12 can be omitted, construction and fabrication are simplified.

In the above explanation, the configuration is explained in which the surface of the glass board is made black in advance and then the grooves are defined by using the sand blast method and the like. However, without carrying out a blacked process, it is naturally allowable to carry out the blacked process of the upper portions of the barriers 5 after the grooves are formed.

Example

The substrate is fabricated in such a way that a width at the cell bottom portion is 300 μm, a height of each of the barriers is 160 μm (including the black portion at the top portion of the barrier of 20 μm), a width of each of the barriers is 100 μm, the film thickness of the fluorescent material is 12 μm and the film thickness of each of the data electrodes is 10 μm. As for the cover plate, the panel is assembled by using the glass plate having the same specification as the prior art. 500 Torr of He, Ne and Xe is filled as mixed gas. Then, when actually carrying out the lighting test, it is possible to reduce flicker of a screen to approximate 1/10, improve the brightness by approximate 8% and reduce the extraneous light reflection coefficient by 15%. As a result, the display contrast is improved, and a preferable result can be obtained.

As explained above, when using the configuration of the color plasma display panel according to the present invention, the discharge gap is easily made constant. Thus, it is possible to easily establish Paschen's law to thereby carry out the discharge operation smoothly. As a result, the present invention has an advantage of obtaining a screen performance with little flicker. Also, the brightness and contrast are improved. Furthermore, since the insulation layer can be omitted, this is effective in simplifying from the viewpoint of the construction and the fabrication.

What is claimed is:

1. A color plasma display panel comprising:

a substrate having a plurality of grooves therein forming discharge cells;

a first group of electrodes respectively coated on entire side walls and bottom of said grooves, each electrode in said first group of electrodes being a single uniform layer of the same material; and a cover plate having a second group of electrodes, said second group of electrodes and said first group of electrodes being arranged so as to form said discharge cells between said cover plate and said substrate.

2. The color plasma display panel according to claim 1, wherein each said electrode in said first group of electrodes is entirely covered with a fluorescent layer of uniform thickness.

3. A color plasma display panel according to claim 1, wherein a top surface of each of said grooves is black.

4. A color plasma display panel comprising: a substrate having a plurality of grooves therein for discharge cells;

a first group of electrodes of a single material layer respectively coated on entire surfaces of said grooves;

a fluorescent layer electrically deposited on entire surfaces of said first group of electrodes so as to have a uniform thickness; and a cover plate having a second group of electrodes, said second group of electrodes and said first group of electrodes being arranged so as to form said discharge cells between said cover plate and said substrate.

5. A method of fabricating a color plasma display panel comprising the steps of forming a plurality of grooves in a substrate;

forming a first group of electrodes on entire surfaces of said grooves by using an additive method so that the electrodes are a single layer of the same material;

forming a fluorescent layer on entire surfaces of said first group of electrodes; and disposing a cover plate having a second group of electrodes on said substrate to form a plurality of discharge cells defined by said first and second group of electrodes.

6. The method according to claim 5, wherein said fluorescent layer is formed by an electric deposition method.

7. The method according to claim 6, wherein said first group of electrodes are deposition electrodes for depositing said fluorescent layer.

8. The method according to claim 5, wherein said plurality of grooves are formed by sand blasting.

9. The method according to claim 5, wherein said first group of electrodes are formed by electroless plating.

10. A color plasma display panel comprising:

a substrate having a plurality of barriers for discharge cells formed thereon;

a first group of electrodes respectively coated on entire side walls and bottom of said cells, each of said first group of electrodes being a single uniform layer of the same material;

fluorescent layers respectively coated on entire surfaces of said first group of electrodes, each of said fluorescent layers having a uniform thickness; and a cover plate having a second group of electrodes, said second group of electrodes and said first group of electrodes being arranged so as to form said discharge cells between said cover plate and said substrate.

11. A color plasma display panel according to claim 10, wherein a top surface of each of said barriers is black.

* * * * *